US009797347B2

(12) United States Patent
Peters et al.

(10) Patent No.: US 9,797,347 B2
(45) Date of Patent: Oct. 24, 2017

(54) HYBRID VEHICLE FUEL VAPOR CANISTER

(71) Applicant: Ford Global Technologies, LLC, Dearborn, MI (US)

(72) Inventors: Mark W. Peters, Wolverine Lake, MI (US); Mark Daniel Bunge, Dearborn, MI (US); Michael G. Heim, Brownstown, MI (US); Russell Randall Pearce, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 142 days.

(21) Appl. No.: 14/039,834

(22) Filed: Sep. 27, 2013

(65) Prior Publication Data

US 2015/0090232 A1 Apr. 2, 2015

(51) Int. Cl.

| | |
|---|---|
| ***F02M 25/08*** | (2006.01) |
| ***F02D 41/00*** | (2006.01) |
| ***F02D 19/06*** | (2006.01) |

(52) U.S. Cl.

CPC ..... *F02M 25/0854* (2013.01); *F02D 19/0621* (2013.01); *F02D 41/003* (2013.01); *F02D 41/004* (2013.01); *F02D 41/0032* (2013.01); *F02D 41/0037* (2013.01); *F02D 41/0042* (2013.01); *F02D 41/0045* (2013.01); *F02M 25/089* (2013.01); *F02M 25/0836* (2013.01); *F02M 25/0872* (2013.01)

(58) Field of Classification Search

CPC ..... F02M 25/0854; F02M 2025/0881; F02M 25/0836; F02M 25/08; F02M 25/0809; F02M 25/0827; F02M 25/0872; F02M 25/089; F02D 19/0621; F02D 41/003; F02D 41/0032; F02D 41/0037; F02D 41/004; F02D 41/0042; F02D 41/0045

USPC ..... 123/520, 518, 519, 521; 180/314

See application file for complete search history.

(56) References Cited

U.S. PATENT DOCUMENTS

| | | | | |
|---|---|---|---|---|
| 3,660,979 A | | 5/1972 | Kamakura et al. | |
| 4,732,588 A | | 3/1988 | Covert et al. | |
| 4,962,744 A | * | 10/1990 | Uranishi et al. | 123/520 |
| 5,095,866 A | * | 3/1992 | Burke | 123/179.14 |
| 5,113,834 A | * | 5/1992 | Aramaki | F02M 25/0809 123/198 D |
| 5,143,035 A | * | 9/1992 | Kayanuma | 123/198 D |

(Continued)

FOREIGN PATENT DOCUMENTS

| | | |
|---|---|---|
| JP | 2004036600 A | 2/2004 |
| JP | 2011509367 A | 3/2011 |

OTHER PUBLICATIONS

Dudar, Aed M. et al., "Hybrid Vehicle Fuel Vapor Canister," U.S. Appl. No. 14/039,964, filed Sep. 27, 2013, 47 pages.

(Continued)

*Primary Examiner* — Stephen K Cronin
*Assistant Examiner* — Susan Scharpf
(74) *Attorney, Agent, or Firm* — James Dottavio; McCoy Russell LLP

(57) ABSTRACT

Embodiments for controlling fuel vapors are disclosed. In one example, a method comprises during a purge of a fuel vapor canister, adjusting a heater of the fuel vapor canister based on a rate of a purge flow exiting the fuel vapor canister and a concentration of hydrocarbons released from the fuel vapor canister. In this way, a fuel vapor canister purge efficiency may be increased.

19 Claims, 6 Drawing Sheets

(56) References Cited

U.S. PATENT DOCUMENTS 5,429,098 A * 7/1995 Tomisawa ..... 123/520
5,560,347 A * 10/1996 Reddy et al. ..... 123/520
5,921,222 A 7/1999 Freeland
6,622,691 B2 * 9/2003 Bagnasco ..... F02D 41/0032 123/295
6,640,783 B2 11/2003 Braun et al.
6,659,087 B1 * 12/2003 Reddy ..... F02D 41/0045 123/357
6,689,196 B2 * 2/2004 Amano et al. ..... 96/112
6,695,895 B2 * 2/2004 Hyodo ..... F02M 25/089 123/519
6,817,346 B2 * 11/2004 Konishi et al. ..... 123/519
6,823,851 B2 * 11/2004 Amano ..... F02M 25/08 123/520
7,233,845 B2 * 6/2007 Veinotte ..... 701/34.4
7,900,607 B2 * 3/2011 Lang et al. ..... 123/518
8,181,631 B2 * 5/2012 Bohr ..... F02M 25/0854 123/520
8,297,262 B2 10/2012 Lang et al.
2005/0005918 A1 1/2005 Newhouse et al.
2007/0266997 A1 * 11/2007 Clontz ..... B01D 53/0438 123/519
2009/0320805 A1 * 12/2009 Lang et al. ..... 123/518
2010/0094493 A1 * 4/2010 Atsumi ..... 701/22
2011/0247592 A1 10/2011 Kim et al.
2011/0265768 A1 * 11/2011 Kerns et al. ..... 123/521
2012/0111848 A1 5/2012 Kim
2012/0138022 A1 * 6/2012 Ryu et al. ..... 123/520
2012/0222656 A1 * 9/2012 Makino et al. ..... 123/519
2012/0291896 A1 11/2012 Shade
2012/0325356 A1 12/2012 Chatfield et al.

OTHER PUBLICATIONS

Anonymous, "Method of Controlling Canister Temperature Using Piezo-Electric Material to Improve Emissions in HEV," IPCOM No. 000234770, Published Feb. 3, 2014, 2 pages.

Anonymous, "Carbon Canister With Internal Peltier Devices to Improve Hydrocarbon Desorption," IPCOM No. 000240795, Published Mar. 3, 2015, 2 pages.

* cited by examiner

HYBRID VEHICLE FUEL VAPOR CANISTER

FIELD

The present disclosure relates to fuel vapor management in a hybrid vehicle.

BACKGROUND AND SUMMARY

Vehicles include a fuel vapor canister to trap diurnal, running loss, and refueling recovery fuel vapors. Such fuel vapor canisters trap the fuel vapors with an adsorbent media, such as activated carbon, and purge the stored fuel vapors to the engine for combustion. However, in hybrid vehicles that are propelled at least periodically by an electric motor and not the engine, the engine may not run for a relatively long duration, particularly after a refueling event has occurred. Because any adsorbed fuel vapors are stored in the canister until the engine can consume them, the long durations between engine operations can lead to high vapor load on the canister, causing bleed-through emissions and other issues. Further, because engine heat is not available during electric operation, the fuel vapor canister may drop in temperature, reducing the efficiency of a subsequent fuel vapor purge.

The inventors herein have recognized the above issues and offer an approach to at least partly address them. In one embodiment, a method comprises, during a purge of a fuel vapor canister, adjusting a heater of the fuel vapor canister based on a rate of a purge flow exiting the fuel vapor canister and a concentration of hydrocarbons released from the fuel vapor canister.

In this way, the one or more heaters of the fuel vapor canister may be adjusted based on characteristics of the endothermic reaction occurring during the purge in order to maintain the canister at a temperature that promotes efficient release of the fuel vapors from the canister without wasting excess energy to operate the heaters during the entire purge process. For example, activation of the one or more heaters may be delayed following start of purge until the endothermic reaction, as measured by the concentration of fuel vapors being released from the fuel vapor canister, reaches a high enough rate to significantly affect canister temperature and thus hinder subsequent release of the fuel vapors. Once the concentration of fuel vapors reaches a threshold level, the one or more heaters may be activated to promote additional fuel vapor release from the storage media.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
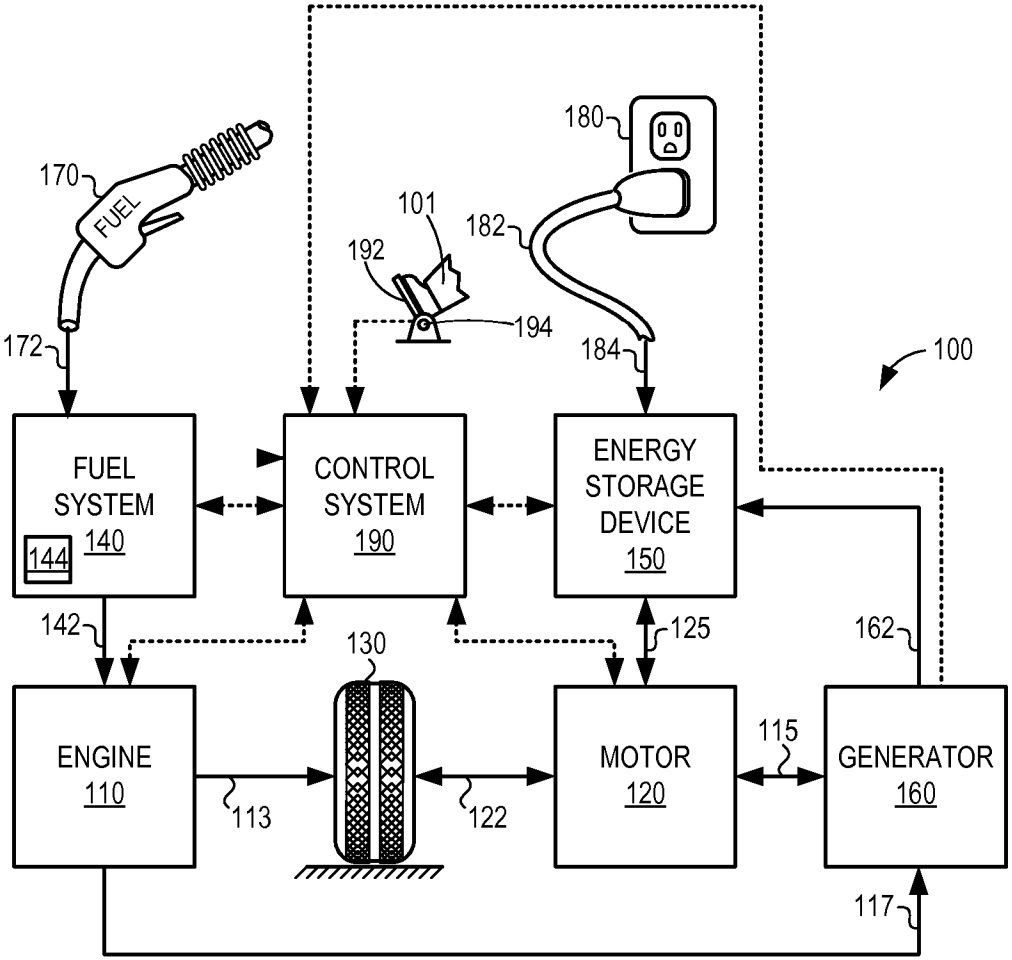
FIG. 1 shows a schematic diagram of a vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150 such as a battery. For example, motor 120 may receive wheel torque from drive wheel 130 as indicated by arrow 122 where the motor may convert the kinetic energy of the vehicle to electrical energy for storage at energy storage device 150 as indicated by arrow 125. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 113 while motor 120 is deactivated. During other operating conditions, both engine 110 and motor 120 may each be operated to propel the vehicle via drive wheel 130 as indicated by arrows 113 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 117, which may in turn supply electrical energy to one or more of motor 120 as indicated by arrow 115 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 113 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Vehicle propulsion system 100 may be controlled at least partially by a control system 190 including controller. Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 101. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (state-of-charge).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it will be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion.

This plug-in hybrid electric vehicle, as described with reference to vehicle propulsion system 100, may be configured to utilize a secondary form of energy (e.g. electrical energy) that is periodically received from an energy source that is not otherwise part of the vehicle.

Figure 2:
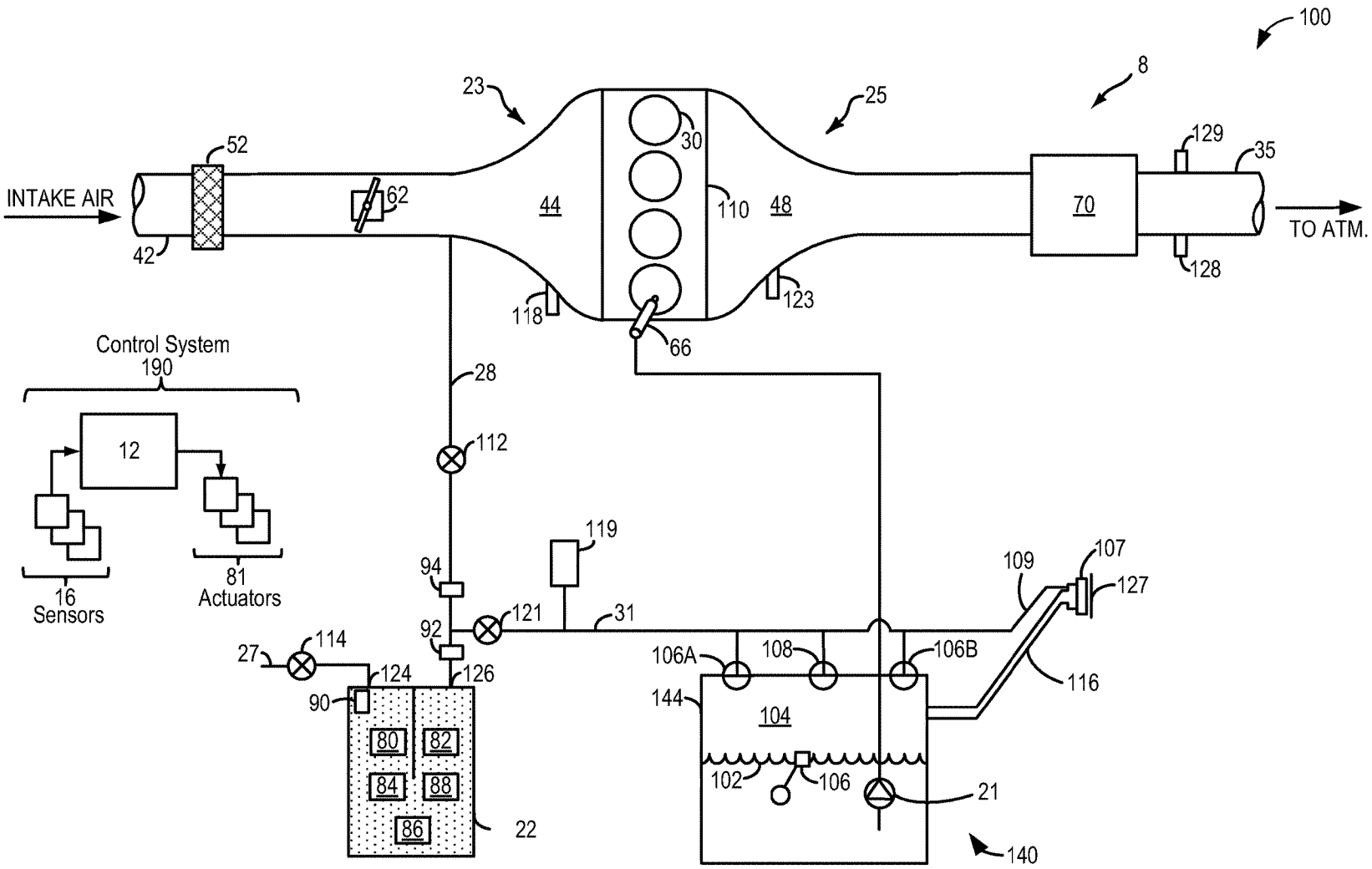
FIG. 2 shows a schematic diagram of an engine system.

As shown in FIG. 2, engine 110 may be included as part of engine system 8, also controlled by control system 190. Control system 190 includes a controller 12 configured to receive inputs from various sensors and trigger action of various actuators, as will be described in further detail below. Engine system 8 may include an engine 110 having a plurality of cylinders 30. Engine 110 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

When configured as a hybrid vehicle system, the vehicle system may be operated in various modes. The various modes may include a full hybrid mode or battery mode, wherein the vehicle is driven by power from only the battery (e.g., energy storage device 150), also referred to as an electric-only mode. The various modes may further include an engine mode wherein the vehicle is propelled with power derived only from the combusting engine. Further, the vehicle may be operated in an assist or mild hybrid mode wherein the engine is the primary source of torque and the battery selectively adds torque during specific conditions, such as during a tip-in event. A controller (e.g., controller 12) may shift vehicle operation between the various modes of operation based at least on vehicle torque/power requirements and the battery's state of charge. For example, when the power demand is higher, the engine mode may be used to provide the primary source of energy with the battery used selectively during power demand spikes. In comparison, when the power demand is lower and while the battery is sufficiently charged, the vehicle may be operated in the battery mode to improve vehicle fuel economy.

Engine system 8 is coupled to fuel system 140. Fuel system 140 includes a fuel tank 144 coupled to a fuel pump 21 and a fuel vapor canister 22. Fuel tank 144 receives fuel via a refueling line 116, which acts as a passageway between the fuel tank 144 and a refueling door 127 on an outer body of the vehicle. During a fuel tank refueling event, fuel may be pumped into the vehicle from an external source (such as fuel dispensing device 170) through refueling inlet 107 which is normally covered by a gas cap. During a refueling event, one or more fuel tank vent valves 106A, 106B, 108 (described below in further detail) may be open to allow refueling vapors to be directed to, and stored in, canister 22. Further, a gas cap may enable fuel tank vacuum or pressure relief via, for example, a poppet valve. In other embodiments, the fuel system may be capless.

Fuel tank 144 may hold a plurality of fuel blends, including fuel with a range of alcohol concentrations, such as various gasoline-ethanol blends, including E10, E85, gasoline, etc., and combinations thereof. A fuel level sensor 106 located in fuel tank 144 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 110, such as example injector 66. While only a single injector 66 is shown, additional injectors are provided for each cylinder. It will be appreciated that fuel system 140 may be a return-less fuel system, a return fuel system, or various other types of fuel system.

Vapors generated in fuel tank 144 may be routed to fuel vapor canister 22, via conduit 31, before being purged to engine intake 23. Fuel tank 144 may include one or more vent valves for venting diurnals and refueling vapors generated in the fuel tank to fuel vapor canister 22. The one or more vent valves may include active vent valves that may be electronically or mechanically actuated (that is, valves with moving parts that are actuated open or close by a controller) and/or passive valves (e.g. valves that are actuated open or close passively based on a tank fill level). In the depicted example, fuel tank 144 includes gas vent valves (GVV) 106A, 106B at either end of fuel tank 144 and a fuel level vent valve (FLVV) 108, all of which are passive vent valves. Each of the vent valves 106A, 106B, and 108 may include a tube (not shown) that dips to a varying degree into a vapor space 104 of the fuel tank. Based on a fuel level 102 relative to vapor space 104 in the fuel tank, the vent valves may be open or closed. For example, GVV 106A, 106B may dip less into vapor space 104 such that they are normally open. This allows diurnal and "running loss" vapors from the fuel tank to be released into canister 22, preventing over-pressurizing of the fuel tank. As another example, FLVV 108 may dip further into vapor space 104 such that it is normally open. This allows fuel tank overfilling to be prevented. In particular, during fuel tank refilling, when a fuel level 102 is raised, vent valve 108 may close, causing pressure to build in vapor line 109 (which is downstream of refueling inlet 107 and coupled thereon to conduit 31) as well as at a filler nozzle coupled to the fuel pump. The increase in pressure at the filler nozzle may then trip the refueling pump, stopping the fuel fill process automatically, and preventing overfilling.

It will be appreciated that while the depicted embodiment shows vent valves 106A, 106B, 108 as passive valves, in alternate embodiments, one or more of them may be configured as electronic valves electronically coupled to a controller (e.g., via wiring). Therein, a controller may send a signal to actuate the vent valves open or close. In addition, the valves may include electronic feedback to communicate an open/close status to the controller. While the use of electronic vent valves having electronic feedback may enable a controller to directly determine whether a vent valve is open or closed (e.g., to determine if a valve is closed when it was supposed to be open), such electronic valves may add substantial costs to the fuel system. Also, the wiring required to couple such electronic vent valves to the controller may act as a potential ignition source inside the fuel tank, increasing fire hazards in the fuel system.

Returning to FIG. 2, fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23, specifically intake manifold 44, via purge line 28 by opening canister purge valve 112. While a single canister 22 is shown, it will be appreciated that fuel system 18 may include any number of canisters.

Canister 22 includes a vent line 27 (herein also referred to as a fresh air line) for routing gases out of the canister 22 to the atmosphere when storing, or trapping, fuel vapors from fuel tank 144. Vent line 27 may be fluidically coupled to canister 22 via vent port 124. Vent port 124 thus fluidically couples canister 22 to atmosphere. Vent line 27 may also allow fresh air to be drawn into fuel vapor canister 22 through vent port 124 when purging stored fuel vapors to engine intake 23 via purge line 28 and purge valve 112. While this example shows vent line 27 communicating with fresh, unheated air, various modifications may also be used. Vent line 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. By closing canister vent valve 114, the fuel tank may be isolated from the atmosphere.

As such, vehicle propulsion system 100 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, in some embodiments, fuel tank isolation valve 121 may be optionally included in conduit 31 such that fuel tank 144 is coupled to canister 22 via isolation valve 121. When included, isolation valve 121 may be kept closed during engine operation so as to limit the amount of diurnal vapors directed to canister 22 from fuel tank 144. During refueling operations, and selected purging conditions, isolation valve 121 may be temporarily opened to direct fuel vapors from the fuel tank 144 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits.

One or more pressure sensors 119 may be coupled to fuel system 140 for providing an estimate of a fuel system pressure. In one example, the fuel system pressure is a fuel tank pressure, wherein pressure sensor 119 is a fuel tank pressure sensor coupled to fuel tank 144 for estimating a fuel tank pressure or vacuum level. While the depicted example shows pressure sensor 119 coupled between the fuel tank and canister 22, in alternate embodiments, the pressure sensor may be directly coupled to fuel tank 144.

Fuel vapors released from canister 22, for example during a purging operation, may be directed into engine intake manifold 44 via purge line 28. The flow of vapors out of canister 22 may be routed through a purge port 126 of canister 22, which fluidically couples canister 22 to the engine, specifically to the intake manifold 44. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 118 coupled to intake manifold 44 and communicated with controller 12. Alternatively, MAP may be inferred from alternate engine operating conditions, such as mass air flow (MAF), as measured by a MAF sensor (not shown) coupled to the intake manifold.

Fuel system 140 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve 114 to direct refueling and diurnal vapors into canister 22 while preventing fuel vapors from being directed into the intake manifold. As another example, the fuel system may be operated in a refueling mode (e.g., when fuel tank refueling is requested by a vehicle operator), wherein the controller 12 may maintain canister purge valve 112 closed, to depressurize the fuel tank before allowing enabling fuel to be added therein. As such, during both fuel storage and refueling modes, the fuel tank vent valves 106A, 106B, and 108 are assumed to be open.

As yet another example, the fuel system may be operated in a canister purging mode (e.g., after an emission control device light-off temperature has been attained and with the engine running), wherein the controller 12 may open canister purge valve 112 and open canister vent valve 114. As such, during the canister purging, the fuel tank vent valves 106A, 106B, and 108 are assumed to be open (though is some embodiments, some combination of valves may be closed). During this mode, vacuum generated by the intake manifold of the operating engine may be used to draw fresh air through vent line 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

In some embodiments, canister 22 may include one or more heaters configured to increase the temperature of the adsorbent material in the canister in order to increase the release of trapped hydrocarbons (e.g., fuel vapors) from the canister. For example, as the trapped fuel vapors are released from the canister during a purge, an endothermic reaction occurs, causing the temperature of the adsorbent material to decrease. The decreased temperature in turn slows the release of the fuel vapors. To ensure a maximum amount of fuel vapors are released, one or more heaters may be activated to maintain the canister at a desired temperature. As shown, canister 22 includes a plurality of heaters embedded in the canister. However, in some embodiments, one or more heaters may be located outside the canister, such as in vent line 27, to heat the fresh air before being admitted to the canister.

In the embodiment illustrated in FIG. 2, canister 22 includes five heaters. A first heater 80 is positioned near the vent port 124. A second heater 82 is positioned near the purge port 126. Three additional heaters 84, 86, and 88, are spaced throughout canister between first and second heaters 80, 82. In some examples, the heaters may be positioned in the path that the fresh air takes as it travels through the canister during a purge (e.g., from the vent port to the purge port). Thus, the heaters may be positioned based on a purge flow path. The heaters may be discretely controlled by the controller 12, such that each heater is turned on and turned off individually (and in some embodiments, regulated to a specific temperature) based on desired operating parameters. For example, first heater 80 may be configured to be activated earlier during a purge than second heater 82, as first heater 80 may be exposed to the purge flow before second heater 82. By controlling each heater individually, each region of the canister 22 may be regulated to a temperature suited for increased release and/or storage of fuel vapors. For example, the heaters may be activated successively in a direction of purge flow through the fuel vapor canister.

In some examples, the one or more heaters may be regulated based on the characteristics of the endothermic reaction occurring in the canister. During the initial stages of the purge, when the rate of the endothermic reaction is relatively low, the temperature of the canister may be relatively high due to the low endothermic reaction rate. Then, as the reaction rate increases, the temperature of the canister may decrease. As such, when a purge is initiated (e.g., when the purge valve 112 is opened during engine operation), the heaters may be activated when the temperature of the canister drops below a lower threshold temperature. In another example, the heaters may be activated when an amount of released fuel vapors (e.g., hydrocarbons) exceeds a first threshold level. Further, the heaters may be deactivated when the canister temperature exceeds an upper temperature threshold and/or deactivated when the amount of released hydrocarbons drops below a second threshold level (lower than the first threshold level in some examples). When the canister reaches a respective threshold temperature and/or when the concentration of released hydrocarbons reaches a respective level, all the heaters may be activated/deactivated simultaneously. In other embodiments, each heater may activated/deactivated individually based on the characteristics/parameters of the canister (such as temperature) in the region surrounding the respective heater.

To determine the temperature of the canister, one or more temperature sensors may be present in the canister or in the vent line 27 or purge line 28. As shown in FIG. 2, a temperature sensor 90 is present in the vent line 27 near the vent port 124. Another temperature sensor 92 is present in the purge line 28 near the purge port 126. Further, one or more purge flow sensors 94 may be present in purge line 28 to determine the concentration and/or flow rate of the fuel vapors being routed to the engine. For example, purge flow sensor 94 may be an oxygen sensor, hydrocarbon sensor, and/or mass flow sensor.

As explained above, the one or more heaters may be activated during a purge to maintain the canister at a desired temperature. However, in some embodiments it may be desired to maintain the canister at a designated temperature even during non-purge conditions. For example, vehicle propulsion system is a hybrid vehicle, and thus includes modes where the vehicle is propelled by energy stored in the battery (via the motor) and not propelled by the engine. During the electric or battery mode, purge of the canister may not be carried out, as no combustion is occurring in the engine. As a result, the canister may become loaded during non-engine operating conditions, and the canister may be purged at the next engine operating period. However, the canister temperature may drop to a relatively low temperature during the engine-off period, and heating the canister during the purge may result in a period of ineffective purge, causing hydrocarbons to release to atmosphere and/or reducing the efficiency of the purge. To counteract this, the heaters may be activated during non-engine operation periods even when purge is not occurring, to keep the canister at a higher designated temperature. To reduce the energy needed to activate the heaters during these conditions, the canister may be maintained at a temperature below that desired for purge, but yet higher than ambient temperature. To achieve this, the one or more heaters may be provided with modulated power (e.g., only activated periodically) or provided with a constant, low level of power.

Additionally, when the vehicle is propelled only by energy from the battery (and not from the engine), the engine may be started when a purge is indicated. As will be explained in more detail below, a purge may be indicated based on a temperature profile of the canister, as determined based on feedback from temperature sensor 90. For example, as fuel vapors are stored in the canister, the temperature of the canister may increase due to the exothermic reaction that occurs during the storage of the fuel vapors. Then, if the canister becomes fully loaded and/or fuel vapors are released from the canister, the temperature of the canister will decrease. When the controller determines that the canister has reached a peak temperature and its temperature subsequently decreases, it may be determined that fuel vapors containing hydrocarbons are being released to atmosphere, and the engine may be started to initiate a purge.

Vehicle propulsion system 100 may further include control system 190 including controller 12. Control system 190 is shown receiving information from a plurality of sensors 16 (various examples of which are described herein) and sending control signals to a plurality of actuators 81 (various examples of which are described herein). As one example, sensors 16 may include exhaust gas (air/fuel ratio) sensor 123 located upstream of the emission control device, exhaust temperature sensor 128, MAP sensor 118, and exhaust pressure sensor 129. Other sensors such as additional pressure, temperature, air/fuel ratio, and composition sensors may be coupled to various locations in the vehicle propulsion system 100. As another example, the actuators may include fuel injector 66, canister purge valve 112, canister vent valve 114, and throttle 62. The control system 190 may include a controller 12. The controller may receive input data from the various sensors, process the input data, and trigger the actuators in response to the processed input data based on instruction or code programmed therein corresponding to one or more routines. Example control routines are described herein with regard to FIGS. 3-5.

Thus, in one embodiment, the system described with respect to FIGS. 1 and 2 provides for a vehicle system comprising: an engine configured to receive fuel from a fuel tank for combustion; a fuel vapor canister configured to trap hydrocarbons in fuel vapor from the fuel tank; a purge line coupling the fuel vapor canister to the engine, the purge line including a canister purge valve and a sensor; a heater positioned in the fuel vapor canister; and a controller storing instructions for: opening the canister purge valve to initiate a purge of hydrocarbons from the fuel vapor canister to the engine; and after the purge is initiated, activating the heater once output from the sensor indicates a concentration of hydrocarbons released from the fuel vapor canister has reached an upper threshold level.

The controller may store further instructions for initiating the purge when a hydrocarbon load of the fuel vapor canister reaches a threshold load. The controller may store further instructions for deactivating the heater once output from the sensor indicates the concentration of hydrocarbons released from the fuel vapor canister has reached a lower threshold level. The sensor may be one or more of a hydrocarbon sensor or a temperature sensor.

In another embodiment, a hybrid vehicle system comprises an engine configured to receive fuel from a fuel tank for combustion; a fuel vapor canister configured to trap fuel vapor released from the fuel tank; a vent line coupling the fuel vapor canister to atmosphere; a purge line coupling the fuel vapor canister to the engine; a temperature sensor positioned in the fuel vapor canister near a vent port coupling the fuel vapor canister to the vent line; and a controller storing instructions for: detecting bleed-through of fuel vapor out of the fuel vapor canister based on output of the temperature sensor; and if bleed-through is detected, opening a canister purge valve positioned in the purge line to route the trapped fuel vapor to the engine; and if the hybrid vehicle is currently propelled by a motor and not the engine, starting the engine prior to opening the canister purge valve.

The system may further comprise a plurality of heaters embedded in the fuel vapor canister, and the controller may store instructions for activating at least one heater of the plurality of heaters if bleed-through is detected. The plurality of heaters may comprise a first heater positioned near a vent port of the fuel vapor canister, the vent port coupling the fuel vapor canister to the vent line, and a second heater positioned near a purge port of the fuel vapor canister, the purge port coupling the fuel vapor canister to the purge line. The controller may store instructions for activating the first heater prior to activating the second heater.

The controller may store instructions for, when the hybrid vehicle is propelled by the motor and not by the engine, adjusting the plurality of heaters to maintain a temperature the fuel vapor canister at a designated temperature, and the activating the at least one heater of the plurality of heaters may comprise adjusting the at least one heater to increase the temperature of the fuel vapor canister above the designated temperature.

The system may further comprise a fuel tank isolation valve positioned in a fuel line coupling the fuel tank to the fuel vapor canister, and the controller may store instructions to open the fuel tank isolation valve during a fuel tank refill event to route the fuel vapors from the fuel tank to the fuel vapor canister.

Figure 3:
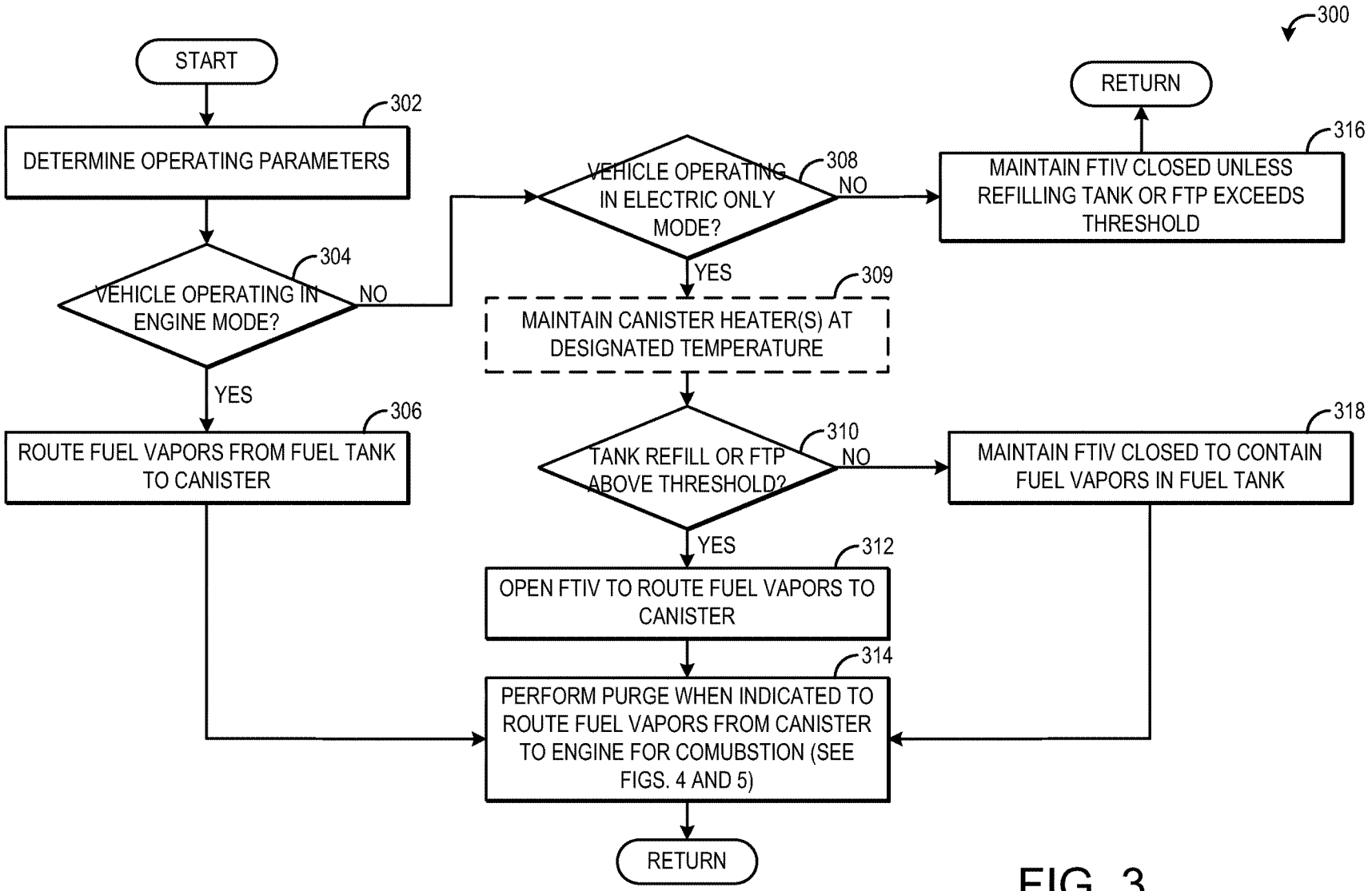
FIGS. 3-5 are flow charts illustrating methods for managing fuel vapors.

Turning now to FIG. 3, flow chart illustrating a high-level method 300 for managing fuel vapors in a vehicle is presented. In one example, the vehicle may be a hybrid vehicle configured to be propelled via energy from one or more of an engine and a battery, such as hybrid vehicle system 100 of FIGS. 1 and 2. Method 300 may be carried out by a vehicle control system according to instructions stored on a controller, such as controller 12.

At 302, vehicle operating parameters are determined. The vehicle operating parameters include, but are not limited to, propulsion mode, vehicle speed, fuel vapor canister temperature, fuel vapor canister load, fuel tank level, fuel tank pressure, etc. At 304, based on the vehicle operating parameters, it is determined if the vehicle is being operated in an engine mode, where combustion in an engine (such as engine 110) provides at least part of the motive force to propel the vehicle. If the vehicle is not operating in an engine mode, method 300 proceeds to 308, which will be discussed below.

If the vehicle is operating in the engine mode, method 300 proceeds to 306 to route fuel vapors from a fuel tank (e.g., fuel tank 144) to a fuel vapor canister, such as canister 22. The fuel vapor canister is configured to store or trap fuel vapors (e.g., hydrocarbons) via an adsorbent media, such as activated carbon. This may include, in some examples, maintaining a fuel tank isolation valve (FTIV 121) open and a canister purge valve (CPV 112) closed. Further, this may include maintaining a canister vent valve (CVV 114) open. In some embodiments, when the engine is operating, fuel vapors may be routed to the fuel vapor canister at all times that fuel vapors are generated. However, in other embodiments, fuel vapors may only be routed to the fuel vapor canister during a fuel tank refill, when fuel tank pressure exceeds a threshold, or other conditions.

When the fuel vapor canister becomes saturated with fuel vapors, the fuel vapors may be purged to the engine and combusted. Thus, as indicated at 314, a fuel vapor canister purge may be performed when indicated to route fuel vapors from the canister to the engine. During the purge, the canister purge valve is opened and fresh air is drawn through the canister. The fresh air will strip the fuel vapors from the activated carbon media of the canister and transport the vapors to the engine. The canister may be purged when the load on the canister reaches a threshold and/or based on other parameters. Additional detail regarding initiating and carrying out a fuel vapor canister purge is presented below with respect to FIGS. 4 and 5.

Returning to 304, if it is determined that the vehicle is not operating in an engine mode, method 300 proceeds to 308 to determine if the vehicle is operating in an electric only mode. During the electric only mode, the vehicle is propelled only by motive force from a battery-operated motor, and not from the engine. If the vehicle is not operating in an electric only mode, it is assumed the vehicle is not currently being operated, and method 300 proceeds to 316, where the fuel tank isolation valve is maintained closed unless fuel tank refill event is occurring or fuel tank pressure (FTP) exceeds a threshold. Method 300 then returns.

Returning to 308, if it is determined that the vehicle is operating in an electric only mode, method 300 proceeds to 309 to optionally maintain one or more canister heaters at a designated temperature. As explained previously, when operating in the electric only mode where the engine is not undergoing combustion, the canister temperature may decrease to a low temperature between canister purges. Then, when the engine is started and a canister purge is performed, the purge efficiency may suffer due to the cold canister and/or delay in heating the canister by one or more heaters. To alleviate this, the one or more heaters (such as the plurality of canister heaters illustrated in FIG. 2) may be periodically activated and/or maintained on at a low power level to heat the canister to a designated temperature even when a purge is not occurring.

At 310, it is determined if a fuel tank refill event is occurring or if fuel tank pressure is above a threshold. During a fuel tank refill, the fuel level in the fuel tank increases, decreasing the volume of the fuel vapor space. As a result, fuel vapors may be pushed out of the fuel tank to the fuel vapor canister. Further, if fuel tank pressure increases above a threshold, damage to the fuel tank may occur, and thus the fuel vapors may be vented to the fuel vapor canister. Thus, if a fuel tank refill event is occurring or if fuel tank pressure is above a threshold, at 312, the fuel tank isolation valve is opened to route fuel vapors to the fuel vapor canister. However, if it is determined that a tank refill event is not occurring or if fuel tank pressure is not above the threshold, the fuel tank isolation valve is maintained closed to contain the fuel vapors in the fuel tank, as indicated at 318.

Figure 4:
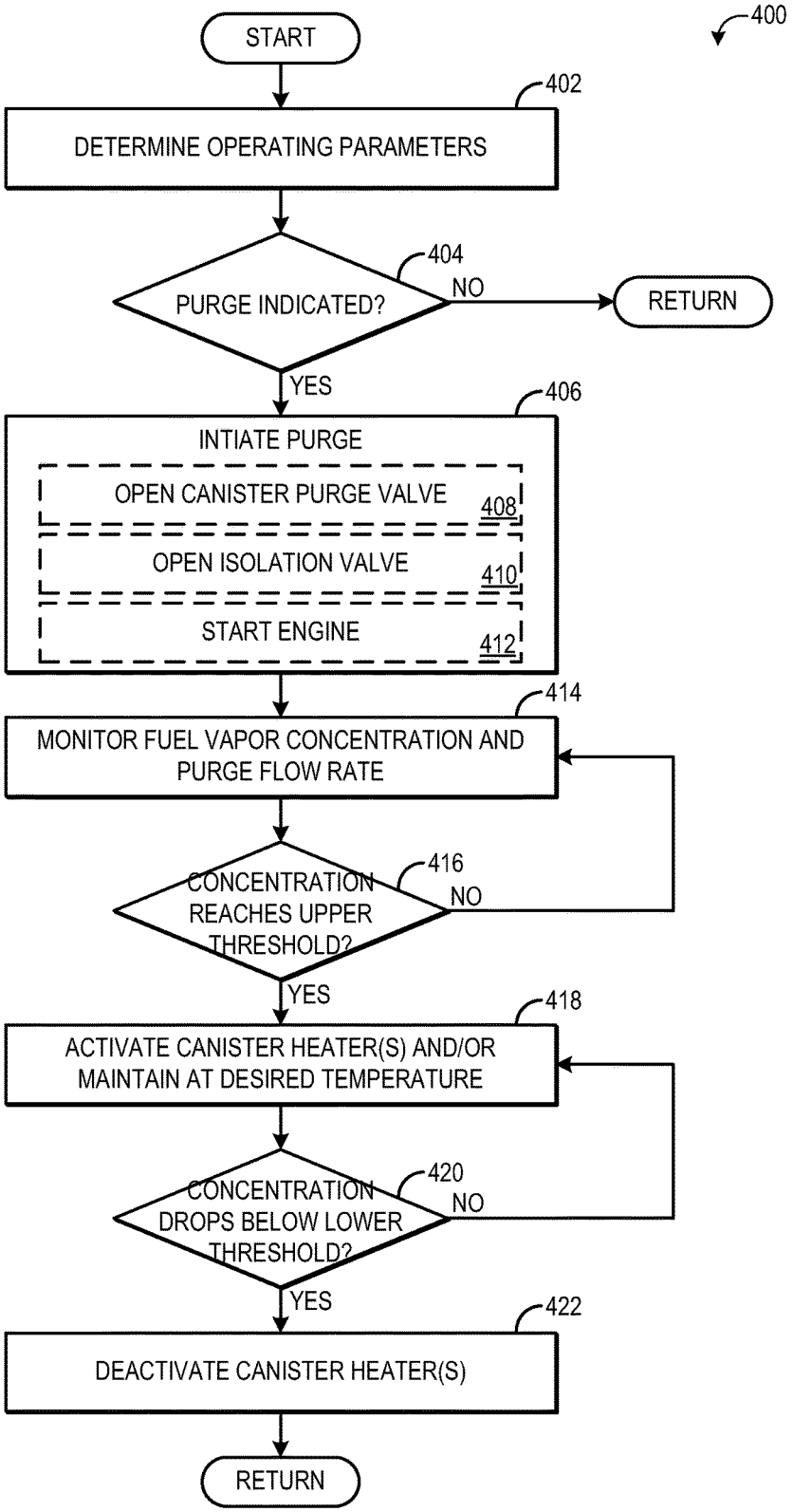
Figure 5:
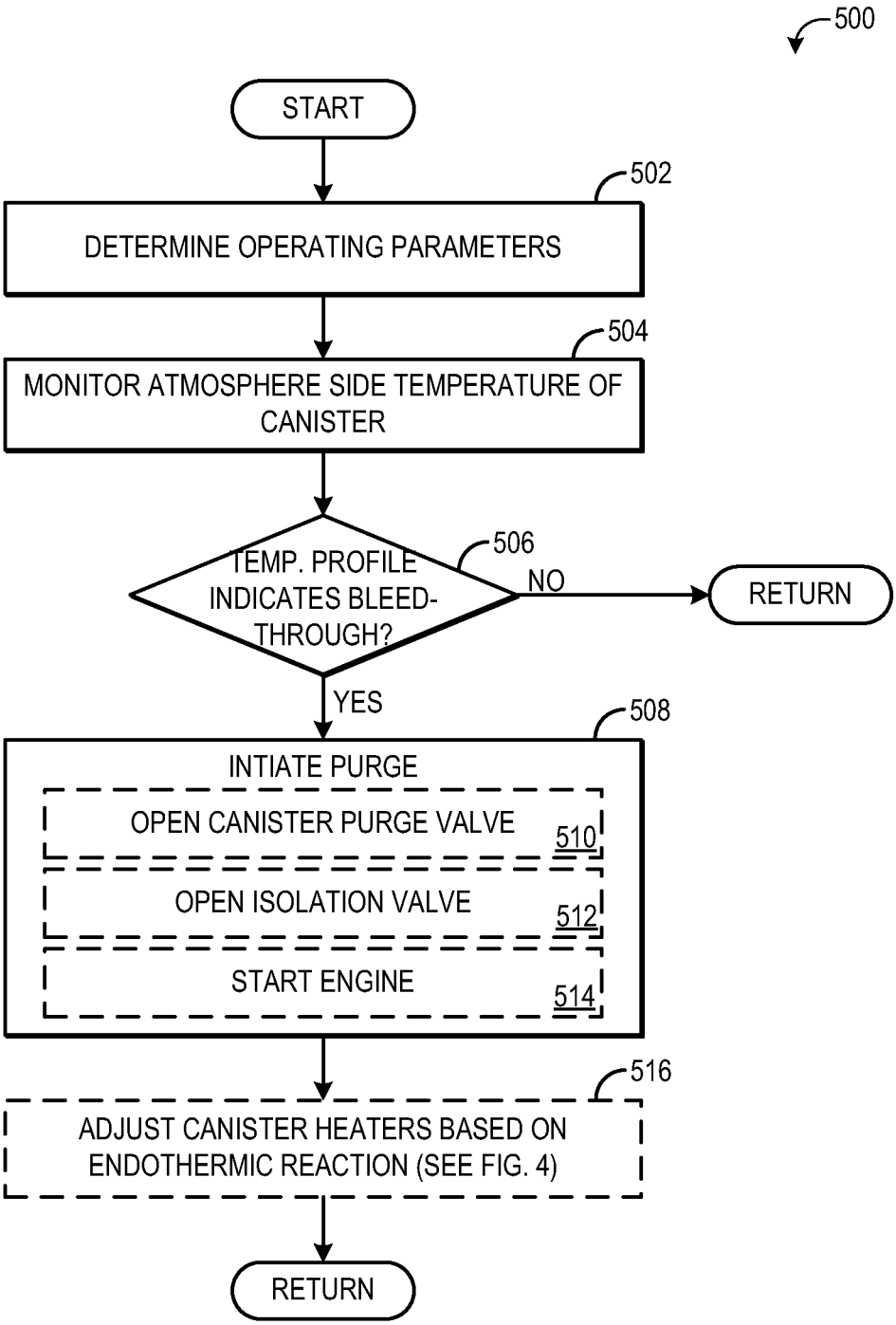

Method 300 then proceeds to 314, where a purge is performed when indicated to route fuel vapors from the fuel vapor canister to the engine for combustion. Various aspects of the purge will be discussed below with respect to FIGS. 4 and 5. For example, FIG. 4 illustrates a method for activating one or more heaters in the canister responsive to an indication that a purge is being performed. FIG. 5 illustrates a method for performing a purge responsive to an indication that fuel vapors are leaking to atmosphere, during an electric-only vehicle mode for example.

FIG. 4 is a flow chart illustrating a method 400 for adjusting one or more canister heaters during a purge of a fuel vapor canister. Method 400 may be carried out as part of method 300, for example as part of the purge indicated at 314 of method 300. Purging a carbon canister used to store hydrocarbons from the fuel tank generates an endothermic reaction that delays the release of hydrocarbons from the storage media. While increasing the purge flow too quickly can potentially cause localized freezing, slowing the purge flow down may increase the release of hydrocarbons from the carbon bed but limits the overall purging on test cycles. To maintain the canister at an optimal temperature during all portions of the purge process, one or more heaters of the fuel vapor canister may be adjusted based on purge flow rate and/or hydrocarbon concentration.

At 402, method 400 includes determining engine operating parameters. The engine operating parameters may include fuel vapor canister load, fuel tank level, vehicle speed, vehicle operating mode (e.g., electric only, engine only, or electric and engine operating modes), and other parameters. At 404, it is determined if a fuel vapor canister purge is indicated. A purge may be indicated when the load on the fuel vapor canister exceeds a threshold. For example, as discussed in more detail below, output from a temperature sensor of the canister may indicate that fuel vapors are escaping the canister and leaking to the atmosphere. In response, a purge of the fuel vapor canister may be carried out. The canister reaching a threshold load may additionally or alternatively determined based on a model of the fuel vapor load on the canister, where the model accounts for the amount of fuel vapor released from the fuel tank (based on fuel tank temperature and pressure, for example), the storage capacity of the fuel vapor canister (based on the amount of fuel vapors purged to the engine during a previous purge), and/or a time since a previous purge was conducted.

If a purge is not indicated (e.g., if the fuel vapor canister is not saturated with fuel vapors), method 400 returns. If a purge is indicated, method 400 proceeds to 406 to initiate a purge. Initiating the purge may include, at 408, opening the canister purge valve. The canister purge valve is positioned in the purge line coupling the canister to the intake manifold of the engine. When the canister purge valve is opened, the vacuum from the intake manifold draws in fresh air from the atmosphere through the canister and to the intake manifold. When the fresh air flows through the canister, the fresh air strips the adsorbent media of the trapped fuel vapors and routes the fuel vapors to the engine, where they are combusted. Initiating the purge may also include opening the fuel tank isolation valve at 410, and if the vehicle is a hybrid vehicle currently operating in an electric-only mode where the vehicle is propelled solely by an electric motor and not by the engine, initiating the purge includes starting the engine at 412.

As explained above, the flow of fresh air through the canister causes the stored fuel vapors to be released from the media of the canister. The release of the stored fuel vapors is an endothermic reaction that consumes heat, and thus over the course the purge, the temperature of the canister will decrease. However, low temperatures inhibit efficient release of the fuel vapors. The rate of the purge flow also influences the release of the fuel vapors. Relatively fast purge flows increase the rate of release, but may cause local freezing the canister. Slowing down the purge flow may increase the release of fuel vapors from the canister, but may limit the overall purging effectiveness. Further, the higher the concentration of fuel vapors in the canister the greater the endothermic reaction.

In order to promote the release of substantially all the stored fuel vapors, the canister may be heated by one or more heaters positioned inside the canister (e.g., embedded in the storage media) or along the housing of the canister. According to embodiments disclosed herein, the heaters may be activated at a particular time of the purge to effectively promote release of the stored fuel vapors, based on the purge flow rate and concentration of hydrocarbons (e.g. fuel vapors) being removed from the canister media. Specifically, at the start of purge, no heat is required due to a lack of endothermic reaction (as only a small amount of vapors are released initially). When purge is enabled, the purge flow is monitored for increasing or peak hydrocarbon concentration, and once an upper threshold concentration (e.g., peak concentration) is reached, the heaters are enabled. When the concentration of hydrocarbons exiting the canister is low (e.g., drops below a lower threshold), the heaters are disabled, as the low hydrocarbon concentration indicates a low potential for endothermic reaction. In some embodiments, if the heater is an air stream heater (e.g., located in the fresh air stream upstream of the canister), the heater is disabled if purge flow is disabled.

Returning to FIG. 4, after purge is initiated, the fuel vapor concentration (e.g., hydrocarbon concentration) and purge flow rate are monitored. The hydrocarbon concentration may be determined based on output from a hydrocarbon or oxygen sensor positioned in the purge flow and the purge flow rate may be determined by a mass flow sensor in the purge line. At 416, it is determined if the hydrocarbon concentration has reached an upper threshold. The upper threshold may a suitable threshold that indicates an endothermic reaction is occurring in the canister. The upper threshold may be a rate of change of the hydrocarbon concentration, such as greater than zero. In other examples, the upper threshold may be a hydrocarbon concentration or mass value, such as a concentration or mass above zero. In another example, the upper threshold may be a portion of a total hydrocarbon load on the canister, such as a mass of released hydrocarbon equivalent to 20% of the total possible load on the canister. In still further examples, the upper threshold may be identified once the hydrocarbon concentration stops increasing and starts to decrease, indicating the endothermic reaction is slowing and/or the rate of release of fuel vapors is decreasing.

If the concentration has not reached the upper threshold, method 400 loops back to 414 to continue to monitor the purge flow rate and hydrocarbon concentration. When the concentration reaches the upper threshold, method 400 proceeds to 418 to activate the one or more canister heaters and/or maintain the heaters at a desired temperature (for example, if the canister heaters are already activated to keep the canister at a designated temperature, the heaters may be adjusted to increase the canister temperature). The temperature to which the canister is heated may be based on the purge flow rate, concentration of hydrocarbons in the purge flow, hydrocarbon load of the canister, and/or other parameters.

At 420, it is determined if the concentration of hydrocarbons in the purge flow has dropped below a lower threshold. The lower threshold may be a suitable threshold that indicates the endothermic reaction that occurs when fuel vapors are released from the canister is at a low enough rate to not impact the temperature of the canister. In one example, the lower threshold is lower than the upper threshold. For example, the lower threshold may be a hydrocarbon concentration of zero. However, other thresholds are possible, such as 90% of possible stored hydrocarbons released from the canister. If the lower threshold of hydrocarbons is not detected, method 400 continues to adjust the heaters to maintain the canister at a desired temperature. If the lower threshold is reached, method 400 proceeds to 422 to deactivate the one or more canister heaters, and then method 400 returns.

Thus, method 400 of FIG. 4 provides for activating one or more canister heaters based on characteristics of the endothermic reaction occurring in the canister when during a purge of the canister. Prior to the purge, the heaters may be deactivated, or may be activated yet powered at a low level so that the canister is below a desired temperature. Once the purge is initiated, activation of the heaters is delayed until the endothermic reaction reaches a high enough rate, as determined based on the hydrocarbon concentration of the purge flow.

Figure 6:
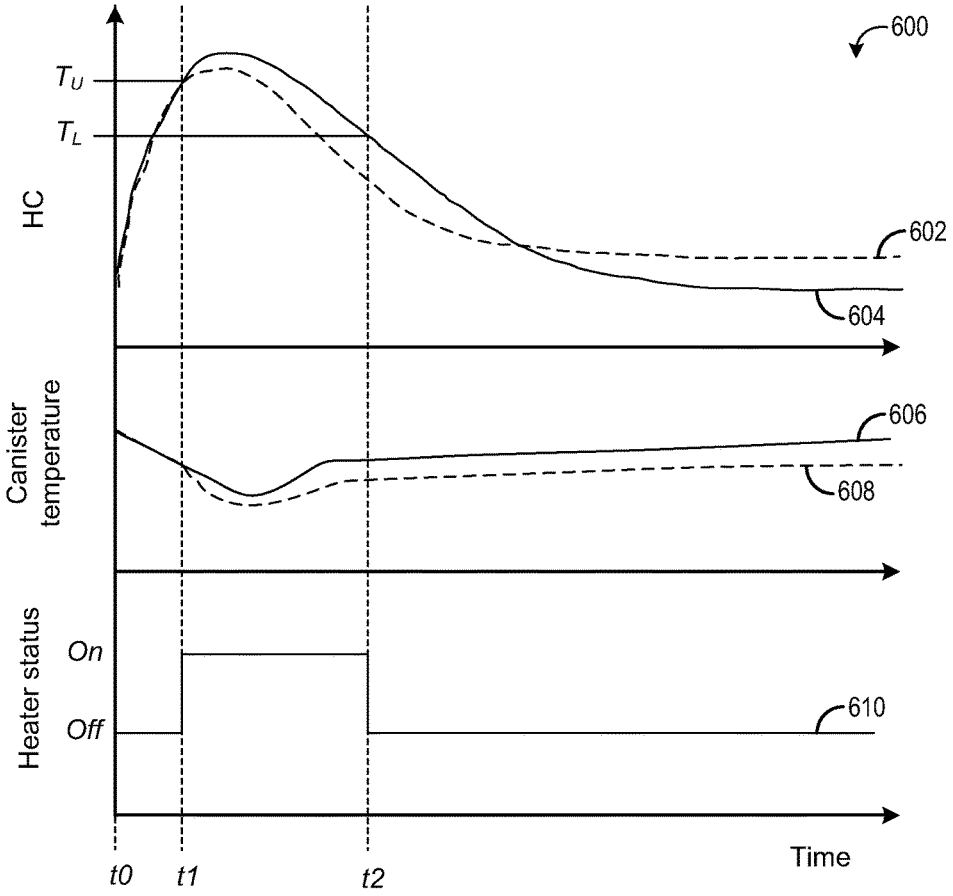
FIG. 6 is a diagram illustrating example parameters of interest during a fuel vapor purge.

FIG. 6 is a diagram 600 illustrating example parameters of interest during a purge according to the embodiment described above with respect to FIG. 4. Specifically, diagram 600 includes hydrocarbon concentration, canister temperature, and heater status prior to and during a purge of a fuel vapor canister. Each respective operating parameter is represented on the vertical axis, while time is depicted along the horizontal axis.

At time t0, a canister purge is initiated based on, for example, the adsorbent media in the canister becoming saturated (e.g., the load on the canister reaching a threshold level). As the canister purge begins, fuel vapors are purged from the canister to the engine intake manifold. As a result, the concentration of hydrocarbons in the purge flow increases, as indicated by curves 602 and 604. Due to the endothermic reaction, the canister temperature starts to drop, as shown by curves 606 and 608. Further, prior to time t1, the heater is off, as illustrated by curve 610.

At time t1, the hydrocarbon concentration reaches the upper threshold $T_u$. The canister heater is activated, and hydrocarbon concentration in the purge flow continues to increase, as shown by curve 602. However, were the heater kept off, the concentration of hydrocarbons would level off and start decreasing, as illustrated by dashed curve 604, which shows the hydrocarbon concentration in a purge without activation of the heater. Similarly, while the canister temperature continues to drop after activation of the heater (curve 606), it decreases less than if the heater is not activated (dashed curve 608).

As the purge progresses, the amount of released fuel vapors decreases (as shown by both curves 602 and 604) and the temperature of the canister increases (as shown by both curves 606 and 608). At time t2, the endothermic reaction has slowed to a point that the hydrocarbon concentration drops to the lower threshold $T_L$. As a result, the heater is deactivated (curve 610), as the endothermic reaction is low enough to not impact release of fuel vapors from the canister.

Thus, as shown in FIG. 6, a canister heater may be activated when the hydrocarbon concentration in the purge flow reaches an upper threshold. This promotes additional release of fuel vapors from the canister, compared to a purge where the canister is not heated. The heater may be deactivated when a substantial amount of the fuel vapors have been released and thus the endothermic reaction is low and does not cause a decrease in the canister temperature. By doing so, the canister heaters may be activated only when needed to maintain canister temperature at a desired temperature. As such, energy is not wasted to keep the canister heaters operating when the endothermic reaction in the canister is low, such as at the beginning of the purge.

In an embodiment, a method comprises during a purge of a fuel vapor canister, adjusting a heater of the fuel vapor canister based on a rate of a purge flow exiting the fuel vapor canister and a concentration of hydrocarbons released from the fuel vapor canister.

The adjusting the heater based on the flow rate of the purge and the concentration of hydrocarbons released from the fuel vapor canister comprises activating the heater when the concentration of hydrocarbons released from the fuel vapor canister reaches a first threshold level. The activating the heater further comprises, when the purge is initiated, delaying activation of the heater until the concentration of hydrocarbons released from the fuel vapor canister reaches the first threshold level.

The adjusting the heater comprises deactivating the heater when the concentration of hydrocarbons released from the fuel vapor canister reaches a second threshold level. The first threshold level may be lower than the second threshold level.

The method may further comprise determining the concentration of hydrocarbons released from the fuel vapor canister based on output from an oxygen sensor coupled between the fuel vapor canister and an engine. The method may further comprise determining the concentration of hydrocarbons released from the fuel vapor canister based on one or more of a temperature of the purge flow and a temperature of the fuel vapor canister.

The method further comprises initiating the purge by opening a canister purge valve to draw fresh air through the fuel vapor canister and route the hydrocarbons to an engine for combustion, the hydrocarbons desorbed by the fresh air.

The heater may be a first heater, and the method may further comprise adjusting a second heater based on the rate of a purge flow exiting the fuel vapor canister and the concentration of hydrocarbons released from the fuel vapor canister. The first heater may be positioned near a vent port coupling the fuel vapor canister to atmosphere and the second heater may be positioned near a purge port coupling the fuel vapor canister to an engine, and the adjusting the first heater and the second heater may comprise activating the first heater prior to activating the second heater.

In another embodiment, a method comprises responsive to a load on a fuel vapor canister exceeding a threshold load, opening a canister purge valve to purge stored hydrocarbons from the fuel vapor canister to an engine; and after the purge is initiated, activating a heater of the fuel vapor canister once a concentration of hydrocarbons released from the fuel vapor canister reaches an upper threshold level.

The method may comprise adjusting the heater to maintain a temperature of fuel vapor canister at a designated temperature, the designated temperature based on one or more of a purge flow rate, the concentration of hydrocarbons, and hydrocarbon load of the fuel vapor canister. The method may further comprise deactivating the heater once the concentration of hydrocarbons released from the fuel vapor canister reaches a lower threshold level. The method may further comprise, when the load on the vapor canister does not exceed the threshold load, maintaining the canister purge valve closed and routing fuel vapors from a fuel tank to the fuel vapor canister. The heater may be a first heater, and the method may further comprise activating a second heater once the concentration of hydrocarbons released from the fuel vapor canister reaches the upper threshold level.

Turning now to FIG. 5, a method 500 for initiating a purge in response to bleed-through of fuel vapors out the vent side of a fuel vapor canister is presented. Method 500 may be carried out as part of method 300 of FIG. 3, for example, to determine if a purge is to be carried out. At 502, method 500 includes determining operating parameters. The determined operating parameters include, but are not limited to, vehicle operating mode (electric only, engine only, or engine and electric, for example), time since a previous purge, whether a fuel tank refill event is occurring, and other parameters. At 504, the atmosphere or vent side temperature of the fuel vapor canister is monitored. The atmosphere-side temperature may be determined based on output from a temperature sensor positioned near the vent port of the fuel vapor canister, such as temperature sensor 90.

At 506, it is determined if a temperature profile based on the monitored vent-side temperature indicates a bleed-through of hydrocarbons out of the canister and to the atmosphere is occurring. The temperature profile may include the temperature of the canister increasing for a duration as fuel vapors are stored in the canister (due to the exothermic reaction that occurs when the hydrocarbons are trapped by the canister storage media) followed by a temperature decrease as the fuel vapors are pushed out and/or released from the canister as the storage media becomes saturated with hydrocarbons.

Figure 7:
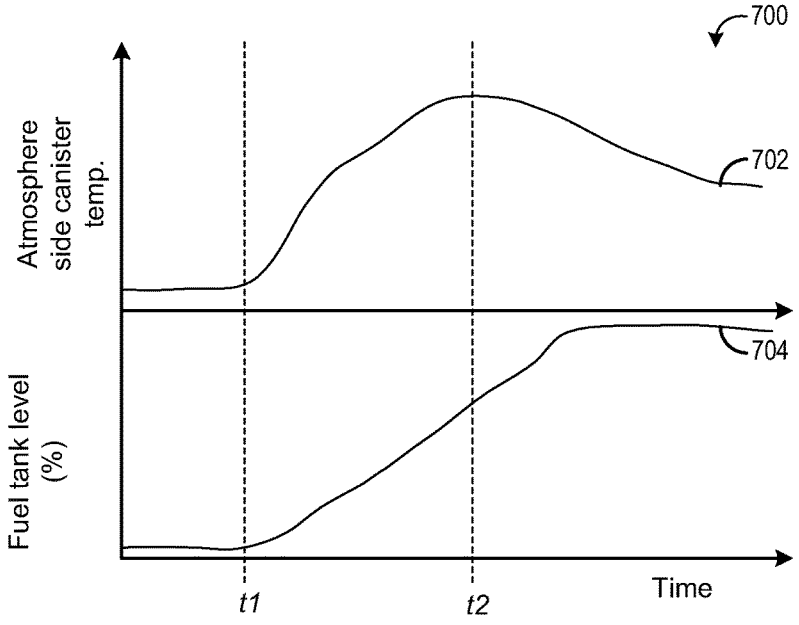
FIG. 7 is a diagram illustrating a temperature profile of a fuel vapor canister during a fuel tank refill vent.

An example temperature profile that indicates bleed-through is occurring is illustrated in FIG. 7. FIG. 7 is a diagram 700 illustrating a temperature profile at the vent side of a fuel vapor canister during a tank refill event. When the fuel tank is refilled, fuel vapors contained in the fuel tank may be pushed out to the fuel vapor canister as the vapor space of the tank decreases due to the increasing fuel level, as well as due to the introduction of additional fuel vapors by the refilling process. Accordingly, if the fuel vapor canister reaches saturation before or during the tank refill, fuel vapors may bleed out of the canister to atmosphere.

The atmosphere-side temperature of the fuel vapor canister is illustrated by curve 702, while the relative fuel tank level is illustrated by curve 704. Atmosphere-side temperature and fuel tank level are depicted along the vertical axis of diagram 700 and time is depicted along the horizontal axis. At time t1, a fuel tank refill event is initiated, and the fuel level in the tank increases. As a result, the temperature at the vent-side of the canister also increases (curve 702) due to storage of the fuel vapors released from the fuel tank during the refill event. The vent-side temperature reaches a peak at time t2 and then starts to decrease, and, as shown by curve 704, the fuel refill event is still occurring. As such, the fuel vapor canister has reached its full load (e.g., is saturated with fuel vapors), and the temperature decrease is indicative of bleed-through of fuel vapors. At time t2, when the vent-side temperature of the canister reaches a peak temperature (e.g., inflection point of the temperature over time), a purge of the fuel vapor canister may be initiated. However, if the bleed-through is detected during a fuel refill event, the purge may be delayed until the tank refill is complete and the vehicle is started.

Returning to FIG. 5, if a bleed-through is not detected, method 500 returns. If a bleed-through is detected, for example, if the temperature of the vent side of the canister increases by more than a threshold rate or if a temperature increase is detected followed by a subsequent decrease in temperature (a temperature curve inflection point is identified), method 500 proceeds to 508 to initiate a purge. Similar to the purge described above with respect to FIG. 4, initiating the purge may include opening the canister purge valve at 510, opening the fuel tank isolation valve at 512, and/or starting the engine at 514, if the vehicle is currently being operated in an electric-only mode. At 516, method 500 optionally includes adjusting one or more canister heaters based on the endothermic reaction occurring during the purge, as described above with respect to FIG. 4, and then method 500 returns.

Thus, according the embodiment described above with respect to FIG. 5, a bleed-through of fuel vapors out of the canister may be detected by monitoring the temperature of the vent-side of the fuel vapor canister. Once the last region of the fuel vapor canister at the fresh air side (e.g., vent side) has adsorbed hydrocarbons and becomes saturated, a heating followed by a cooling effect occurs. This inflection point indicates that breakthrough has occurred, and the engine control strategy may be notified that a purge is needed. If the engine is not currently running (but the vehicle is being operated by a motor, for example), the engine may be started to carry out the purge.

In an embodiment, a method comprises initiating a purge of a fuel vapor canister responsive to a temperature profile at a vent side of the fuel vapor canister. Initiating the purge responsive to the temperature profile at the vent side of the fuel vapor canister may comprise initiating the purge responsive to a temperature of fuel vapor canister near a vent port of the fuel vapor canister increasing to a peak temperature and then subsequently decreasing in temperature. The purge may be initiated when the peak temperature is identified.

Initiating the purge responsive to the temperature profile at the vent side of the fuel vapor canister may comprise initiating the purge responsive to a temperature profile identified based on feedback received from a temperature sensor positioned adjacent to a vent port of the fuel vapor canister, the vent port fluidically coupling the fuel vapor canister to atmosphere.

The method may further comprise, prior to initiating the purge, routing fuel vapors from a fuel tank to the fuel vapor canister to trap the fuel vapors in the fuel vapor canister. Initiating the purge may comprise opening a canister purge valve to draw fresh air into the fuel vapor canister and purge the trapped fuel vapor to an engine for combustion. The engine may be installed in a hybrid vehicle configured to receive motive force from the engine or a motor, and initiating the fuel vapor canister purge may further comprise starting the engine. The method may further comprise, after opening the canister purge valve, activating one or canister heaters to maintain the fuel vapor canister at a designated temperature.

In another embodiment, a method for managing fuel vapors in a hybrid vehicle configured to be propelled by a motor or by an engine comprises during non-purge conditions while the engine is inactive, detecting fuel vapors exiting a fuel vapor canister to atmosphere based on a temperature of an atmosphere side of the fuel vapor canister reaching a peak temperature; and if fuel vapor exiting the fuel vapor canister is detected, starting the engine and opening a canister purge valve to route fuel vapor in the fuel vapor canister to the engine for combustion.

The detecting fuel vapor based on the temperature of the atmosphere side of the fuel vapor canister may comprise determining the temperature of the atmosphere side of the fuel vapor canister based on output from a temperature sensor positioned near a vent port coupling the fuel vapor canister to atmosphere. The method may further comprise, during the non-purge conditions while the engine is inactive, routing fuel vapors from a fuel tank to the fuel vapor canister. The routing fuel vapors from the fuel tank to the fuel vapor canister may comprise opening a fuel tank isolation valve when fuel tank pressure exceeds a threshold.

The method may further comprise if fuel vapor is detected, activating one or more heaters embedded within the fuel vapor canister. The activating one or more heaters may comprise activating the one or more heaters successively in a direction of purge flow through the fuel vapor canister.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

responsive to a fuel vapor load on a fuel vapor canister exceeding a threshold load, initiating a purge of the fuel vapor canister; and during the purge of the fuel vapor canister, adjusting a heater of the fuel vapor canister based on a rate of a purge flow exiting the fuel vapor canister and a concentration of hydrocarbons in the purge flow, including:

delaying activation of the heater until the concentration of hydrocarbons in the purge flow increases to a first threshold level; and activating the heater responsive to onset of an endothermic reaction in the fuel vapor canister as detected by the concentration of hydrocarbons increasing to the first threshold level.

2. The method of claim 1, wherein the first threshold level includes a peak concentration of hydrocarbons, and wherein the first threshold level is different from the threshold load.

3. The method of claim 1, wherein adjusting the heater comprises deactivating the heater when the concentration of hydrocarbons in the purge flow reaches a second threshold level.

4. The method of claim 3, wherein the first threshold level is higher than the second threshold level, and further comprising, continuing to purge fuel vapor after the heater is deactivated.

5. The method of claim 3, further comprising determining the concentration of hydrocarbons in the purge flow based on output from an oxygen sensor coupled between the fuel vapor canister and an engine.

6. The method of claim 3, further comprising determining the concentration of hydrocarbons in the purge flow based on one or more of a temperature of the purge flow and a temperature of the fuel vapor canister.

7. The method of claim 1, wherein initiating the purge comprises initiating the purge by opening a canister purge valve to draw fresh air through the fuel vapor canister and route the hydrocarbons to an engine for combustion, the hydrocarbons desorbed by the fresh air.

8. The method of claim 1, wherein the heater is a first heater, and further comprising adjusting a second heater based on the rate of the purge flow exiting the fuel vapor canister and the concentration of hydrocarbons in the purge flow, wherein the first heater is positioned near a vent port coupling the fuel vapor canister to atmosphere, wherein the second heater is positioned near a purge port coupling the fuel vapor canister to an engine, and wherein adjusting the first heater and the second heater comprises activating the first heater prior to activating the second heater.

9. The method of claim 1, further comprising initiating the purge responsive to a temperature of the fuel vapor canister at a vent port of the fuel vapor canister increasing to a peak temperature and then subsequently decreasing in temperature.

10. The method of claim 1, wherein adjusting the heater based on the rate of purge flow comprises adjusting the heater to maintain the fuel vapor canister at a desired temperature based on the purge flow rate.

11. A vehicle system, comprising:

an engine configured to receive fuel from a fuel tank for combustion;

a fuel vapor canister configured to trap hydrocarbons in fuel vapor from the fuel tank;

a purge line coupling the fuel vapor canister to the engine, the purge line including a canister purge valve and a sensor;

a heater positioned in the fuel vapor canister; and a controller storing instructions for:

opening the canister purge valve to initiate a purge of hydrocarbons from the fuel vapor canister to the engine;

after the purge is initiated, purging the hydrocarbons with the heater deactivated until a concentration of hydrocarbons in the purge line has increased to a peak concentration of hydrocarbons; and activating the heater once output from the sensor indicates the concentration of hydrocarbons in the purge line has increased to the peak concentration of hydrocarbons.

12. The system of claim 11, wherein the controller stores further instructions for initiating the purge responsive to a temperature of the fuel vapor canister at a vent port of the fuel vapor canister increasing to a peak temperature and then subsequently decreasing in temperature.

13. The system of claim 12, wherein the temperature of the fuel vapor canister at the vent port is determined based on output from a temperature sensor positioned in a vent line fluidly coupled to the vent port, the vent port coupling the fuel vapor canister to atmosphere, and wherein the controller stores further instructions for deactivating the heater once output from the sensor indicates the concentration of hydrocarbons in the purge line has reached a lower threshold level.

14. The system of claim 13, wherein the sensor is one or more of a hydrocarbon sensor or a temperature sensor, and wherein the controller stores further instructions for continuing to purge hydrocarbons from the fuel vapor canister to the engine after the deactivation of the heater.

15. A method, comprising:

responsive to a load on a fuel vapor canister exceeding a threshold load, opening a canister purge valve to purge stored hydrocarbons from the fuel vapor canister to an engine without activating a heater; and after the purge is initiated, activating the heater of the fuel vapor canister once a concentration of hydrocarbons in a purge flow increases to an upper threshold level.

16. The method of claim 15, wherein opening the canister purge valve further comprises purging the stored hydrocarbons while maintaining the heater in a deactivated state until the concentration of hydrocarbons in the purge flow increases to the upper threshold level, and further comprising, once the heater is activated, adjusting the heater to maintain a temperature of the fuel vapor canister at a designated temperature, the designated temperature based on one or more of a purge flow rate, the concentration of hydrocarbons, and a hydrocarbon load of the fuel vapor canister.

17. The method of claim 16, further comprising deactivating the heater once the concentration of hydrocarbons in the purge flow reaches a lower threshold level while continuing to purge the stored hydrocarbons.

18. The method of claim 15, further comprising, when the load on the fuel vapor canister does not exceed the threshold load, maintaining the canister purge valve closed and routing fuel vapors from a fuel tank to the fuel vapor canister.

19. The method of claim 15, wherein the heater is a first heater, and further comprising activating a second heater once the concentration of hydrocarbons in the purge flow reaches the upper threshold level.

* * * * *